US005215365A

United States Patent [19]

Godin

[11] Patent Number: 5,215,365

[45] Date of Patent: Jun. 1, 1993

[54] CONCEALABLE TRASH RECEPTACLE

[76] Inventor: Joseph G. Godin, 25052 Alex, Center Line, Mich. 48015

[21] Appl. No.: 846,594

[22] Filed: Mar. 5, 1992

[51] Int. Cl.[5] ..... A47B 88/00

[52] U.S. Cl. ..... 312/328; 312/211; 16/370

[58] Field of Search ..... 312/328, 329, 211, 212; 16/345, 370; 126/194

[56] References Cited

U.S. PATENT DOCUMENTS

| | | | |
|---|---|---|---|
| 715,869 | 12/1902 | Rickel et al. | 16/370 |
| 721,327 | 2/1903 | Rickel et al. | 16/370 |
| 1,817,773 | 8/1931 | Sipe | 16/370 |
| 2,131,576 | 9/1938 | Biegler | 16/370 |
| 2,175,577 | 10/1939 | Soss | 16/370 |
| 2,601,069 | 6/1952 | Strumbos | 312/211 |
| 2,758,900 | 8/1956 | Marchand | 312/328 |
| 3,575,483 | 4/1971 | Church | 312/328 |
| 3,666,214 | 5/1972 | Matuska | 312/328 |
| 3,980,856 | 9/1976 | Allen et al. | 126/194 |
| 4,114,967 | 9/1978 | Weekly | 312/328 |
| 4,287,873 | 9/1981 | Goins et al. | 126/194 |
| 4,683,614 | 8/1987 | Anderson . | |
| 5,061,023 | 10/1991 | Soubliere et al. | 312/328 |

*Primary Examiner*—Victor N. Sakran
*Attorney, Agent, or Firm*—Peter D. Keefe

[57] ABSTRACT

A concealable trash receptacle structured to be concealed within a cabinet when not in use, and out in the open for the deposit of trash thereinto by movement of a trash holder and a front panel connected therewith. The concealable trash receptacle is composed of a base for connecting to building cabinetry, a hinge connected to the base, a frame connected with the hinge, a trash holder connected with the frame, and a front panel connected with the frame. The hinge is structured to provide a large radial arcing movement of the frame, and is located relative to the frame so that a torque is created with respect to the center of gravity of the pivotable parts so that gravity biases the pivotable parts. The front panel is in a nominally vertical orientation with the trash holder concealed therebehind when the trash holder is not in use. When access to the trash holder is desired, the front panel is released and the biasing due to gravity causes the pivotable parts to rotate on the hinge. Once trash depositing is completed, the front panel, frame and trash holder are easily rotated back to the vertical orientation.

9 Claims, 3 Drawing Sheets

CONCEALABLE TRASH RECEPTACLE

BACKGROUND OF THE INVENTION

1. Field of the Invention

The present invention relates to trash receptacles, particularly those used indoors. More particularly, the present invention relates to a trash receptacle which forms a portion of the cabinetry of a room of a building, such as a kitchen or office, and is movably structured so as to be concealed when not in use and open when in use for the depositing of trash thereinto.

2. Description of the Prior Art

Refuse generation is a perennial problem in both commercial and residential settings, such as in an office or kitchen. Many types of trash containers have been developed and marketed over the years. Each of these share the concept of a stand-alone open topped box-like device, such as typical lidded or unlidded trash containers.

Trash containers of whatever sort which are used within a building, such as a home or place of business, are generally unsightly. Consequently, many people place the trash container within a cabinet so as to ensure that the trash container is not seen except when it is used for depositing trash thereinto. This "solution" results in a frequently awkward placement that is not efficient for trash disposal in that the trash container is located within the cabinet with its top not well disposed for accepting the deposit of trash. And, in the event the trash container is lined with a replaceable trash bag, extreme inconvenience occurs when it is time to change bags. In those race situations where the trash container and the cabinet are reasonably harmonious in terms of shape and size, there still remains awkwardness associated with opening the cabinet door and tossing trash into the trash container, with an occasional mishap likely to occur.

Accordingly, what is needed in the art is a trash container which is structured to be concealed when not in use for the deposit of trash, and yet is entirely out in the open for the deposit of trash thereinto.

SUMMARY OF THE INVENTION

The present invention is a concealable trash receptacle which is structured to be concealed within a cabinet when not in use, and yet is entirely out in the open for the deposit of trash thereinto by movement of a trash holder and a front panel connected therewith.

The concealable trash receptacle according to the present invention is composed generally of a base for connecting to building cabinetry, a hinge connected to the base, a frame connected with the hinge, a trash holder connected with the frame, and a front panel connected with the frame. The hinge is structured to provide pivotal movement of the frame, and is located relative to the frame so that a torque is created with respect to the center of gravity of the pivotable parts so that gravity biases the pivotable parts.

The front panel is in a nominally vertical orientation with the trash holder concealed therebehind when the trash holder is not in use. When access to the trash holder is desired, the front panel is released and the biasing due to gravity caused rotation on the hinge of the pivotable parts. Once trash depositing is completed, the front panel, frame and trash holder are easily rotated back to the vertical orientation. One or more shock absorbers may be utilized to facilitate gentle movement of the frame with respect to the base. The trash holder may take any form, such as a plastic trash bag supported by the frame, or a lidded trash container as eluded to above, which may or may not be removable from the frame.

Accordingly, it is an object of the present invention to provide a concealable trash receptacle having a trash holder which is selectively operated to move the trash holder concealably into a cabinet and to move the trash holder into an open position for receiving trash.

It is another object of the present invention to provide a concealable trash receptacle which is selectively operated between an open configuration and a closed configuration, composed of a trash holder, a frame supporting the trash holder, and a hinge for hingably connecting the frame to a base, the hinge providing a pivotal movement of the frame and being connected with respect to the frame so that gravity nominally biases the frame toward the open configuration.

It is an additional object of the present invention to provide a concealable trash receptacle having a front panel that moves with a frame hingably connected with a base, which is easily installed and is adaptable for use in essentially any building environment.

These, and additional objects, advantages, features and benefits of the present invention will become apparent from the following specification.

DETAILED DESCRIPTION OF THE PREFERRED EMBODIMENT

Figure 1:
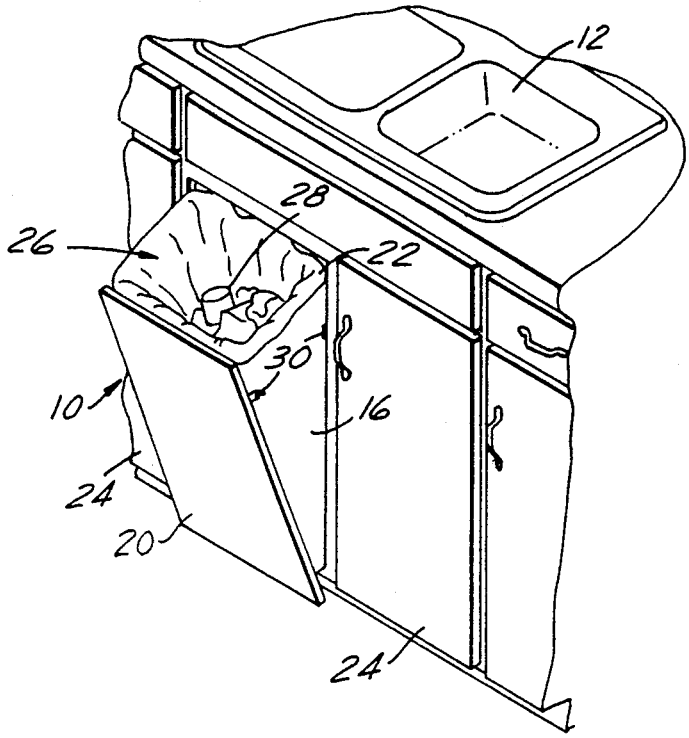
FIG. 1 is a perspective view of the concealable trash receptacle according to the present invention, shown in a kitchen environment of use.
Figure 2:
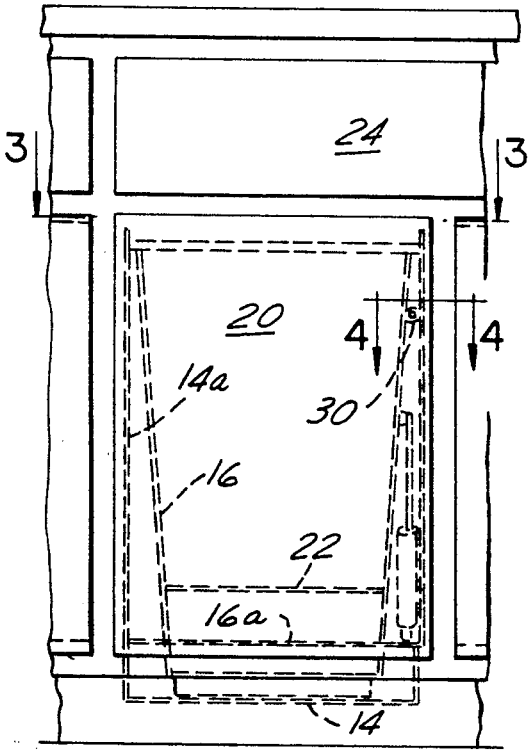
FIG. 2 is a front view of the concealable trash receptacle shown in FIG. 1.
Figure 3:
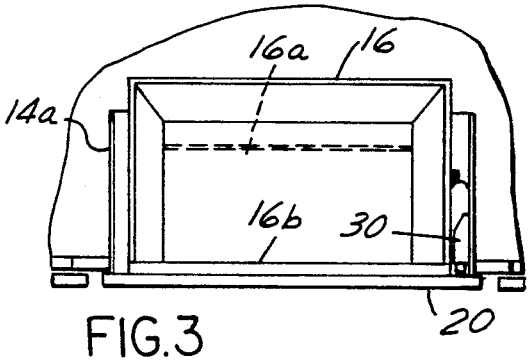
FIG. 3 is a partly sectional top plan view of the concealable trash receptacle, shown along lines 3—3 in FIG. 2.
Figure 4:
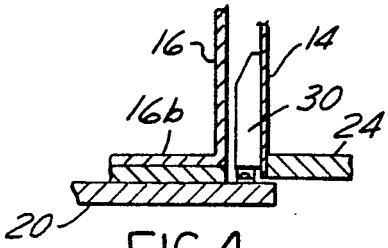
FIG. 4 is a partly sectional view of a latch for a front cover of the concealable trash receptacle, shown along lines 4—4 in FIG. 2 and circle 4 in FIG. 3.

Referring now the Drawing, FIG. 1 shows the concealable trash receptacle 10 according to the present invention in a typical environment of use, namely a household kitchen. In this regard, the concealable trash receptacle 10 is placed in the space underneath the sink 12. Of course, this environment of use and this placement are not requirements, but are simply expositive of an advantageous usage.

Figure 6:
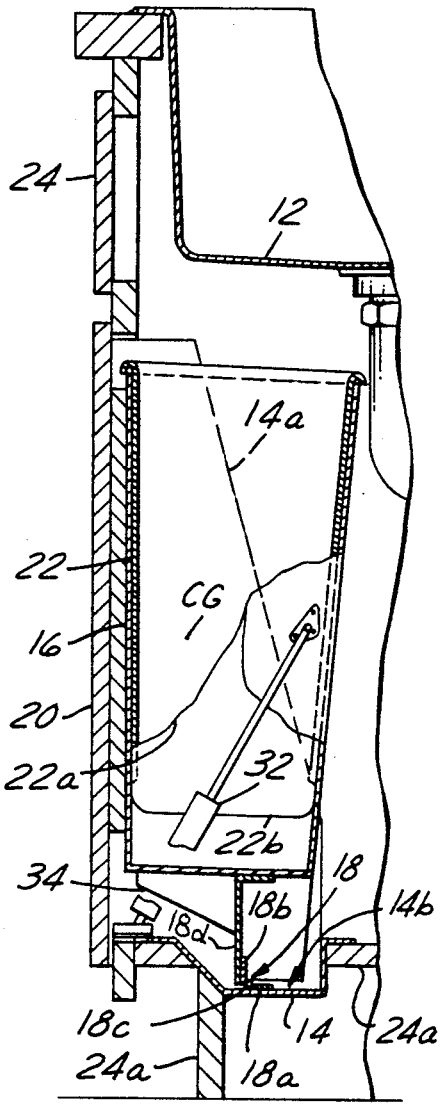
FIG. 6 is a partly sectional side view of the concealable trash receptacle as depicted in FIG. 6, now shown in a concealed configuration.
Figure 7:
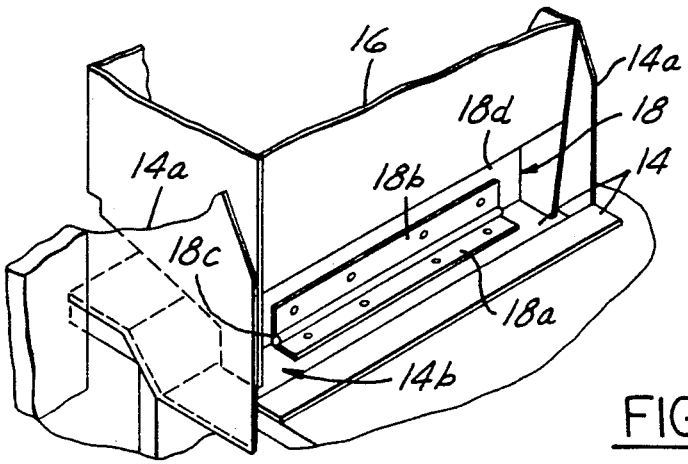
FIG. 7 is a detail perspective view of a first preferred hinge which is operationally depicted in FIGS. 5 and 6.

From FIGS. 1 and 6, it is seen that the concealable trash receptacle 10 is composed generally of a base 14, a frame 16, a hinge 18 which pivotally connects the frame to the base, a front panel 20 connected with the frame, and a trash holder 22 connected with the frame. It is preferred for the front panel 20 to be structured to harmoniously blend with surrounding structures in the building, such as for example matching the size and surface treatment of adjacent cabinets 24.

Figure 5:
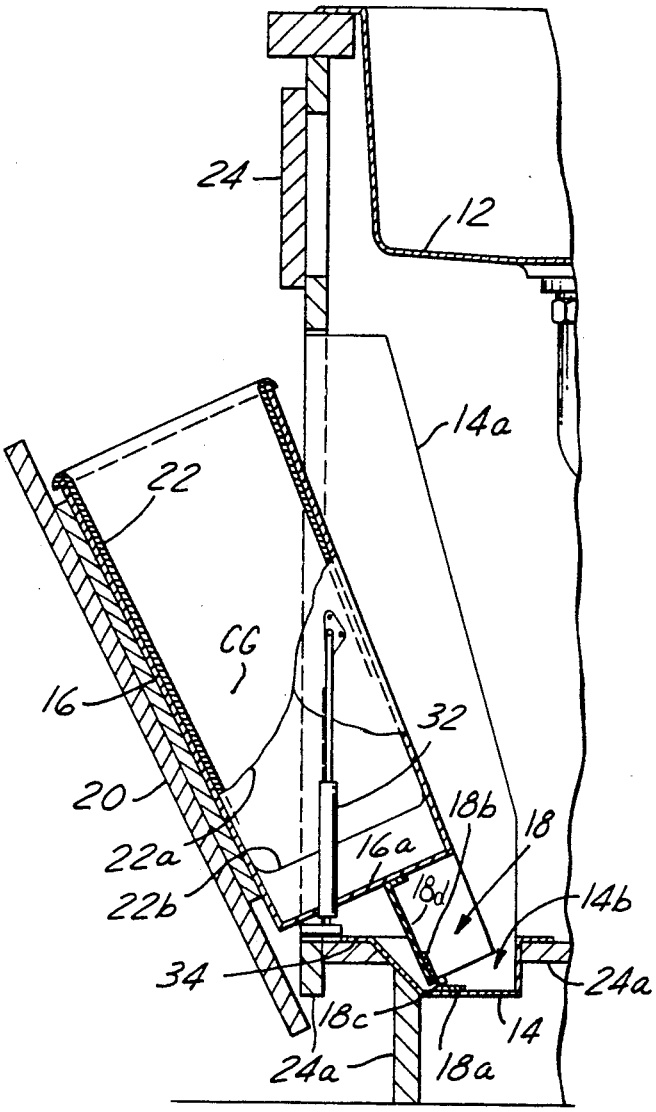
FIG. 5 is a partly sectional side view of the concealable trash receptacle depicted in FIG. 1, shown now in an open configuration.

As indicated in FIGS. 1, 5 and 6, the concealable trash receptacle 10 is structured for being operated between a concealed configuration, as shown in FIG. 6, and an open configuration, as shown in FIGS. 1 and 5. In the concealed configuration, the trash holder 22 is in a first orientation in which it is enclosed by adjacent cabinets 24 and by the front panel 20. In the open configuration in which the trash holder 22 is in a second orientation, the opening 26 of the trash holder is readily accessible to someone wishing to dispose of trash 28 therewithin or to service the trash holder, such as by replacing a trash bag liner 22*a*. The hinge 18 provides movement of the front panel 20, frame 16 and trash holder 22 between the concealed and open configurations, and vice versa.

The base 14 is preferred to be constructed of a strong material, such as a metal, and be structured for being anchored by fasteners, such as screws, with respect to surrounding building structure, such as cabinet framing 24*a*. The base 14 is preferred to include a wing 14*a* on each side for the purpose of providing support for the base as the frame 16 pivots into the open configuration, particularly when the trash holder is laden with trash or any other sort of articles placed thereinto. The wings 14*a* are preferred to be of triangular shape and to connect by welding or other well known fastening means to the base 14 and, via common fasteners, to the cabinet framing 24*a* at a location remote from the base.

The hinge 18 has a stationary portion 18*a* that is connected to the base 14. The hinge 18 further has a pivoting portion 18*b* that is connected with the frame 16. As can be understood by reference to FIGS. 5 and 6, the hinge 18 provides a pivotal movement of the frame. The nature of this pivotal movement will be disclosed in detail hereinbelow after the other structural features of the concealable trash receptacle 10 have been elaborated.

The frame 16 is preferred to be structured of high impact plastic in the form of an open box into which the trash holder 22 may insert, however, this is not a requirement. What is required is that the frame provide a mounting member 16*a* to which the hinge 18 connects and to provide a panel connection member 16*b* to which the front panel 20 connects.

The front panel 20 is connected with the frame 16 at the connection member 16*b* thereof, and is structured to match the design and structure of surrounding cabinetry 24 (or other analogous structure). Cabinet framing 24*a* has been already provided for installation of the concealable trash receptacle 10, and the front panel 20 is dimensioned to fit harmoniously with these dimensions as would be expected of a conventional cabinet door. A latch mechanism 30 is connected with the frame 16 and one of the wings 14*a* of the base 14 (or the adjacent cabinets 24) to provide selective holding of the front panel 20 closed with respect to adjacent cabinetry. The latch mechanism 30 is preferred to be a conventional push-to-lock-push-again-to-unlock latch which is commercially available and is well known in the cabinetry art. While not required, this type of latch permits the front panel 20 to be locked and unlocked with respect to the vertical by the user simply and conveniently pushing against the front panel with his or her knee (which is especially convenient in a situation in which the user's hands are full of articles).

The trash holder 22 may take many different forms, including: the frame 16 serving in this capacity, an insertable trash container 22*b* (as shown in the Drawing) which may or may not be provided with a lining trash bag 22*a*, or simply a trash bag held on a support of some sort that is affixed with respect to the front panel 20 or to the frame 16.

Returning now to the structure for providing pivotal movement of the frame 16, the hinge 18 provides an extended radius arc movement of the mounting member 16*a*. The reason for this movement is to configure the concealable trash receptacle 10 so that the front of the trash holder 22 is able to clear the adjacent cabinet framing 24*a* when being pivoted so as to configure the concealable trash receptacle 10 into the open configuration while providing for a controlled biasing of the frame 16 from the concealed configuration toward the open configuration. This is accomplished by placing the hinge 18 at a location on the base in which: a) the pivoting portion 18*b* is at or substantially near perpendicular with respect to the stationary portion 18*a* when the concealable trash receptacle 10 is in the concealed configuration, whereat the front panel is vertical (in this regard, the pivoting portion 18*b* may be only substantially near vertical, as shown in FIG. 6, in order to concealably accommodate the trash holder 22); and b) the center of gravity CG of the pivotable parts of the concealable trash receptacle 10, the pivotable parts being the front panel 20, frame 16 and trash holder 22, is displaced a predetermined distance from being vertically aligned with the hinge pin 18*c* toward the front panel. The predetermined distance is such as to result in the frame 16 automatically pivoting on the hinge 18 when the latch mechanism 30 is released. A shock absorber 32 is preferred, but not required, to be provided on one or both sides of the frame 16, which, as shown in FIGS. 5 and 6, is connected at one end to the base 14 and at the other end to the frame. The shock absorber 32 is of a conventional structure which effects to slowly allow pivotal movement of the frame 16 relative to the base 14 in response to gravitational biasing in the direction of movement, such as provided by the aspirated piston and cylinder shock absorber 32 shown in the Drawing. Pivotal movement of the frame 16 is preferred, but not required to be, limited by a pair of stops 34, a stop being located on each side of the frame 16. The stops 34 are dimensioned to abut the base 14 when the frame 16 has tilted a maximum permissible amount, as shown in FIGS. 1 and 5. The shock absorber 32 may serve as a stop when fully extended, thereby obviating need for stops 34.

In order that the predetermined distance not be so great that the frame 16 would tend to pivot by gravitational biasing with an excessive amount of force that would risk damage or injury, and in order that the frame pivots so as to clear adjacent cabinet framing 24*a*, a large radius of arc motion is desired. This is achieved by providing the pivoting portion 18*b* of the hinge 18 with an extension member 18*d*. The extension member 18*d* connects at one end to the pivoting portion 18*b* of the hinge 18 and connects at its other end with the mounting member 16*a* of the frame 16. In order to accommodate the length of the extension member 18*d*, the base 14 includes a recessed portion 14*b*. The length of the extension member 18*d* and the length of the aforesaid predetermined distance are coordinated with the overall structural dimensions and weight of the aforesaid pivoting components so that pivoting is automatic, assured and gentle upon release of the latch mechanism 30, with due regard being taken of movement moderation provided by the shock absorber 32.

In operation, a trash holder 22 is in the form of the frame 16 supporting a removable trash container 22*b* which is lined by a trash bag 22*a*. Starting from the open configuration, the user pushes upon the front panel 20 thereby causing it to rotate on the hinge 18 until the lock mechanism 30 locks the front panel in a vertical orientation, whereat the concealable trash receptacle is in the concealed orientation. When it is desired to place trash into the trash holder, the user presses upon the front panel thereby causing the latch mechanism to release. Thereupon, with the user no longer contacting the front panel, the front panel tilts outwardly by rotating on the hinge under gravitational biasing until the stops 34 prevent further movement. Movement is moderated by action of the shock absorber 32 to ensure that it is smooth and gentle, especially at the end of travel. Now, trash (or any other articles) may be deposited or the trash holder serviced. The user then pushes on the front panel to return the concealable trash receptacle to the concealed configuration.

Alternative hinge structures are possible, so that the hinge 18 exposited hereinabove is to be understood as being by way of example only. Accordingly, the hinge 18 is a first preferred example, and for examples of other hinges attention is requested to FIGS. 8 through 13. In common with all hinge structures is the concept of providing a radius of arc of the mounting member 16*a* of the frame 16 in which pivoting in response to gravitational biasing is gentle and there is clearance of the cabinet framing 24*a* by the frame 16 and trash holder 22. The other preferred hinges shown in FIGS. 8 through 13 have the advantage of not requiring that the base 14 be provided with the recessed portion 14*b*.

Figure 8:
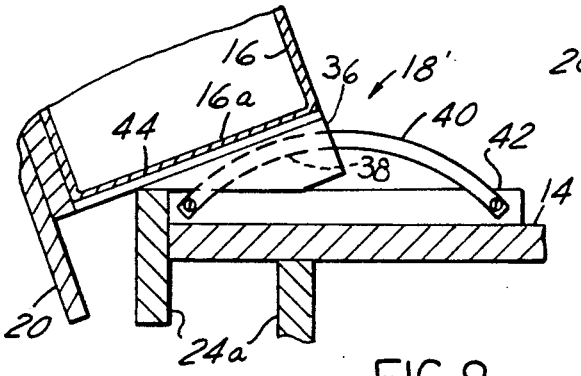
FIG. 8 is a partly sectional side view of the concealable trash receptacle in the open configuration, showing a second preferred hinge.
Figure 9:
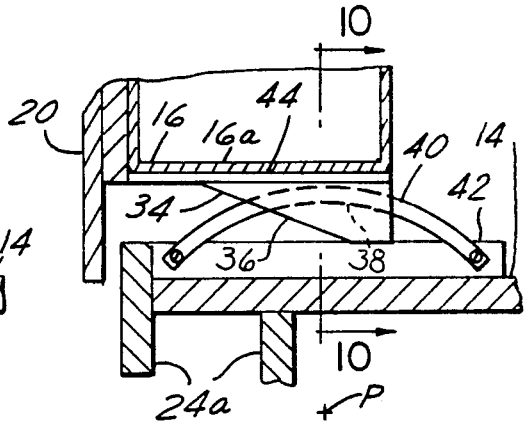
FIG. 9 is a partly sectional side view of the concealable trash receptacle in the concealed configuration, showing in detail the second preferred hinge.
Figure 10:
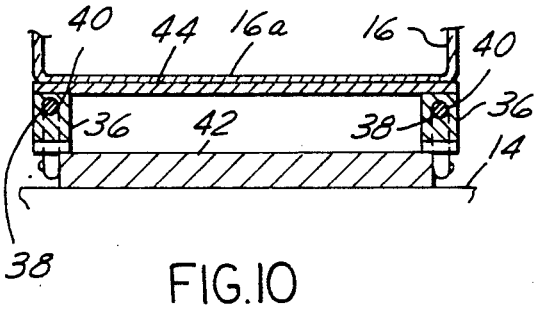
FIG. 10 is a partly sectional end view of the concealable trash receptacle in the concealed configuration, showing in detail the second preferred hinge along lines 10—10 in FIG. 9.

FIGS. 8 through 10 show a second preferred hinge 18' in the form of a track, in which the mounting member 16*a* of the frame 16 is provided with a pair of legs 36 having circularly curved channels 38 therein through which extend circularly curved guides 40 having the same radius of curvature. The circularly curved guides 40 are connected with the base 14 optionally via a base mounting plate 42 that is connected with the base, the base mounting plate 42 serving also to act as the abutment for the stops 34. The mounting member 16*a* guidably travels along the circularly curved guides 40 by operation of the circularly curved channels 38. The legs 36 are preferred to be connected with the frame 16 via a frame mounting plate 44, although the legs could be integrally connected with the frame. In the concealed configuration shown in FIG. 9, the location of the center of curvature P of the circularly curved guides 40 is the same as the location of the hinge pin 18*c* shown in FIG. 6. As a result, the mounting member 16*a* will move the same with the second preferred hinge 18' as it would with the first preferred hinge 18.

Figure 12:
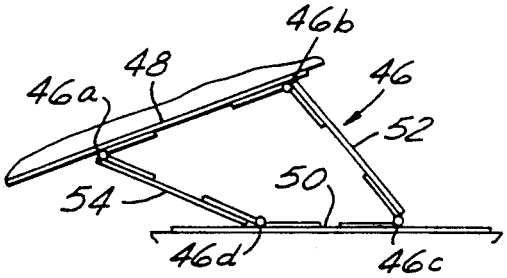
FIG. 12 is a side view of the third preferred hinge, shown with the concealable trash receptacle according to the present invention in the open configuration.
Figure 11:
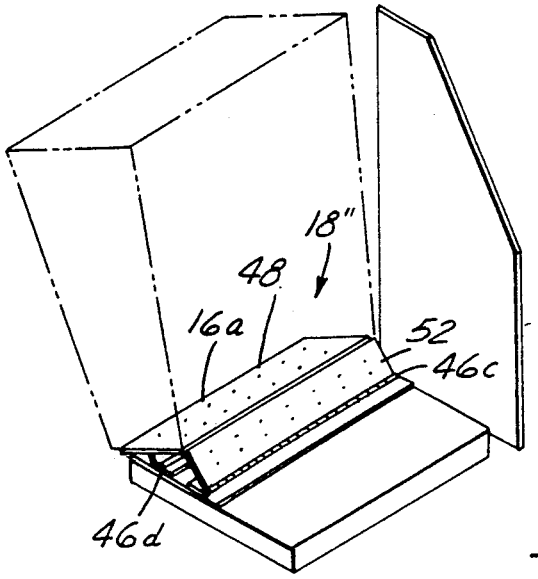
FIG. 11 is a perspective view of the concealable trash receptacle in the open configuration, showing in detail the third preferred hinge.
Figure 13:
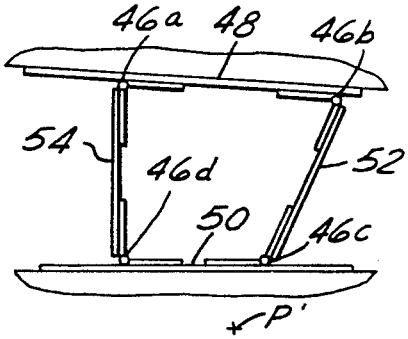
FIG. 13 is a side view of the third preferred embodiment of the hinge, shown with the concealable trash receptacle according to the present invention in the concealed configuration.

FIGS. 11 through 13 show a third preferred hinge 18'' in which the mounting member 16*a* of the frame 16 is connected with a four-component hinge unit 46. The four component hinge unit 46 is composed of four hinges 46*a*, 46*b*, 46*c* and 46*d* which operate in concert to provide a single hingable action with a general location of the center of curvature P' of the four-component hinge that is substantially the same as the location of the hinge pin 18*c* shown in FIG. 6. In this regard, hinge 46*a* is connected with hinge 46*b* via a frame mounting plate 48, hinge 46*b* is connected with hinge 46*c* via a first sidewall plate 52, hinge 46*c* is connected with hinge 46*d* via a base mounting plate 50, and hinge 46*d* is connected with hinge 46*a* via a second sidewall plate 54; the aforesaid components may be integrally connected rather than separately connected, as shown. Hinges 46*a* and 46*b* are separated further than hinges 46*c* and 46*d*, thereby forming a substantially trapezoidal shape when the concealable trash receptacle 10 is in the concealed configuration, as shown in FIG. 13. As a result of this configuration among the four hinge constituents 46*a*, 46*b*, 46*c* and 46*d*, the mounting member 16*a* will move substantially the same with the third preferred hinge 18'' as it would with the first preferred hinge 18.

The concealable trash receptacle 10 is preferred to be a modular unit for providing simple installation and removal with respect to a cabinet opening.

To those skilled in the art to which this invention appertains, the above described preferred embodiment may be subject to change or modification. For instance, while the present invention has been described relative to a preferred form of operation, namely the containment of trash; in fact, the present invention may be used for the containment of articles of any kind, and the trash holder referred to hereinabove may be any sort of articles holder. Further in this regard, the terms "adjacent cabinets" "adjacent cabinetry" and "cabinet framing" are used herein by way of preferred examples of use; in fact these terms are to be interpreted expansively to mean any kind of surrounding structure whether or not actually cabinet structures. Such change or modification can be carried out without departing from the scope of the invention, which is intended to be limited only by the scope of the appended claims.

What is claimed is:

1. A concealable receptacle for use in connection with adjacent cabinetry, adjacent cabinetry being interpreted to mean cabinets and any other kinds of analogous structures, said concealable receptacle comprising:

a base structured for being connected with the adjacent cabinetry;

a hinge having a stationary portion and a pivoting portion, said stationary portion being connected to said base;

a frame connected to said pivoting portion of said hinge, wherein said hinge provides pivotal movement of said frame along an arc having a predetermined radius of curvature, said arc having a center of curvature located at a predetermined location vertically below said frame;

a front panel connected with said frame;

latch means connected with at least one of said frame and said front panel for selectively holding said front panel with respect to said base;

an articles holder connected with at least one of said front panel and said frame, said articles holder having an opening into which may be placed articles for storage; and stop means for providing a maximum limit of pivotal movement of said frame with respect to said base;

wherein said articles holder, said front panel and said frame have a center of gravity, and wherein said articles holder, said front panel and said center of gravity are pivotally movable on said center of curvature from a first orientation to a second orientation defined by said stop means, said front panel in combination with the adjacent cabinetry concealing said articles holder when said articles holder is in said fist orientation, said opening of said articles holder being exterior with respect to the adjacent cabinetry when said articles holder is in said second orientation, said center of gravity being displaced from vertical alignment with respect to said center of curvature so that said articles holder, said front panel, and said frame are biased by gravity from the first orientation to the second orientation, said latch means selectively holding said front panel in said first orientation, said stop means interacting with said frame, said articles holder and said front panel so as to define said second orientation.

2. The concealable receptacle of claim 1, wherein said hinge comprises:

said stationary portion comprising a stationary hinge component structured for being connected with said base;

said pivoting portion comprising a pivotal hinge component;

a pivot pin pivotally connecting said stationary hinge component to said pivotal hinge component, said pivot pin defining said center of curvature; and an extension member connected at one end with said pivotal hinge component and structured for being connected at the other end thereof to said frame, said radius of curvature being defined between said pivot pin and said frame whereat said extension member connects thereto.

3. The concealable receptacle of claim 2, further comprising shock absorbing means connected to said base and said frame for moderating movement of said frame from said first orientation to said second orientation.

4. The concealable receptacle of claim 1, wherein said hinge comprises:

said stationary portion comprising a pair of spaced apart circularly curved guides connected with said base, each circularly curved guide of said pair of circularly curved guides having said radius of curvature; and said pivoting portion comprising a pair of spaced apart legs connected with said frame, each leg of said pair of spaced apart legs having a circularly curved channel of said radius of curvature, each circularly shaped channel being structured for slidably receiving therein a respective circularly shaped guide.

5. The concealable receptacle of claim 4, further comprising shock absorbing means connected to said base and said frame for moderating movement of said frame from said first orientation to said second orientation.

6. The concealable receptacle of claim 1, wherein said hinge is a four-component hinge, wherein said hinge comprises:

said pivoting portion comprising:

a first hinge;

a second hinge;

a frame mounting plate joining said first hinge to said second hinge, said frame mounting plate being connected to said frame;

a third hinge;

a first sidewall plate joining said second hinge to said third hinge;

a fourth hinge; and a second sidewall plate joining said fourth hinge to said first hinge; and said stationary portion comprising:

a base mounting plate joining said third hinge to said fourth hinge, said base mounting plate being connected with said base;

wherein said first hinge, said second hinge, said third hinge and said fourth hinge form corners of substantially a trapezoid when said base mounting plate is substantially parallel with respect to said frame mounting plate, further wherein said first hinge and said second hinge are mutually separated a distance greater than said third hinge is separated from said fourth hinge, wherein said frame mounting plate is pivotable at said center of curvature with respect to said base mounting plate, wherein said radius of curvature exceeds a length defined as that between said base mounting plate and said frame mounting plate.

7. The concealable receptacle of claim 6, further comprising shock absorbing means connected to said base and said frame for moderating movement of said frame from said first orientation to said second orientation.

8. The concealable receptacle of claim 1, further comprising shock absorbing means connected to said base and said frame for moderating movement of said frame from said first orientation to said second orientation.

9. A four-component hinge for pivoting a first object with respect to a second object, wherein the first object pivots along an arc having a predetermined radius of curvature with respect to the second object, the arc having a center of curvature located at a predetermined location with respect to the second object, said four-component hinge comprising:

a first hinge;

a second hinge;

a pivoting plate joining said first hinge to said second hinge, said pivoting plate being connected with the first object;

a third hinge;

a first sidewall plate joining said second hinge to said third hinge;

a fourth hinge;

a stationary plate joining said third hinge to said fourth hinge, said stationary plate being connected with the second object; and a second sidewall plate joining said fourth hinge to said first hinge;

wherein said first hinge, said second hinge, said third hinge and said fourth hinge form corners of substantially a trapezoid when said pivoting plate is substantially parallel with respect to said stationary plate, further wherein said first hinge and said second hinge are mutually separated a distance greater than said third hinge is separated from said fourth hinge; wherein said pivoting plate is pivotable with respect to said stationary plate with a radius of curvature that exceeds a length defined as that between said stationary plate and said pivoting plate.

* * * * *